US005476112A

United States Patent [19]

Matsui et al.

[11] Patent Number: 5,476,112

[45] Date of Patent: Dec. 19, 1995

[54] METHOD AND APPARATUS FOR CLEANING SHUTTER MEMBERS

[75] Inventors: Tadashi Matsui; Mamoru Kinuta; Manabu Shibata, all of Tochigi, Japan

[73] Assignee: Kao Corporation, Tokyo, Japan

[21] Appl. No.: 258,202

[22] Filed: Jun. 10, 1994

[30] Foreign Application Priority Data

Jun. 21, 1993 [JP] Japan ..... 5-149522

[51] Int. Cl.[6] ..... B08B 3/02

[52] U.S. Cl. ..... 134/64 R; 134/122 R; 134/199

[58] Field of Search ..... 134/64 R, 122 R, 134/199, 165, 49, 82; 198/468.11

[56] References Cited

U.S. PATENT DOCUMENTS

| | | | |
|---|---|---|---|
| 524,510 | 8/1894 | Sanderson et al. | 134/165 X |
| 948,046 | 2/1910 | Frankem | 134/165 X |
| 2,199,747 | 5/1940 | Long et al. | 134/199 X |
| 2,207,452 | 7/1940 | Bingman | 134/165 X |
| 3,284,828 | 11/1966 | Jennings et al. | 198/495 |
| 3,654,941 | 4/1972 | Dillon | 134/165 X |
| 3,656,493 | 4/1972 | Black et al. | 134/165 X |
| 4,039,349 | 8/1977 | Kwasnoski et al. . | |
| 4,957,129 | 9/1990 | Krast et al. | 134/199 |

FOREIGN PATENT DOCUMENTS

| | | | |
|---|---|---|---|
| 1196049 | 2/1962 | Germany | 134/82 |
| 3333221 | 3/1984 | Germany . | |
| 329258 | 4/1972 | U.S.S.R. | 134/165 |
| WO92/11099 | 7/1992 | WIPO . | |

OTHER PUBLICATIONS

Patent Abstracts of Japan, vol. 16, No. 86 (C–0916), Mar. 3, 1992, JP–A–03 274 299, Dec. 5, 1991.

*Primary Examiner*—Frankie L. Stinson

*Attorney, Agent, or Firm*—Oblon, Spivak, McClelland, Maier, & Neustadt

[57] ABSTRACT

An apparatus for cleaning stainless steel or aluminum shutter members in a blanked and generally U-shaped form as they are fed continuously comprises a guide rail for guiding the shutter members so that they are transferred in a specified direction and a plurality of cleaning nozzles through which a cleaning solution is sprayed onto the shutter members. A plurality of vessels for supplying the cleaning solution to the Cleaning nozzles are provided along the guide rail and the cleaning solution overflowing a supply vessel downstream the guide rail is allowed to flow into sequentially upstream supply vessels via flow lines. The cleaning solution is recovered from the most upstream supply vessel and, after the cleaning debris is separated out, the cleaning solution is supplied into the most downstream supply vessel. The apparatus enables efficient cleaning of the shutter members.

2 Claims, 2 Drawing Sheets

METHOD AND APPARATUS FOR CLEANING SHUTTER MEMBERS

BACKGROUND OF THE INVENTION

1. Field of the Invention

This invention relates to a method and apparatus for cleaning members of interest and, more specifically, to a method and apparatus that are suitable for cleaning stainless steel, aluminum or other metallic shutter members in a blanked and generally U-shaped form as they are fed continuously.

2. Discussion of the Background

Hard case housings such as containers of recording media are usually fitted with shutter members for opening and closing the slot through which the recording head is to be pushed in such shutter members are typically made of stainless steel or aluminum and they are bent in a generally U-shape that is slidably mounted over opposite sides of the container. The shutter member also has a window which, when in registry with the slot for head insertion, permits the head on the recording apparatus to be pushed in. To fabricate such shutter members from stainless steel, the metal sheet is blanked in a predetermined shape which is then bent in a generally U-shape.

A working oil is used in the blanking step of the process for fabricating shutter members and unless it is removed almost completely before the shutter member is mounted on the container, various troubles may occur. Hence, it is common practice to remove the working oil from the shutter member by either cleaning it with a detergent or rinsing it.

In the conventional methods of cleaning shutter members, the rinsing liquid, detergent and other cleaning media must be used in such large volumes that the treatment of effluents that contain the working oil can cause serious environmental problems. At the same time, recycling of the working oil and other valuables is desirable. Further, to conveyorize their cleaning operation, shutter members may be transferred as they are held by suitable supports and other tools while they are cleaned with a spray of cleaning solution. A problem with this approach is that if holding members or the like are used as the support for transferring shutter members, the holding part will prevent thorough cleaning of the latter. In addition, if slender guide rails or the like are simply used to hold the shutter members in the process of their transfer, the inner surfaces of the shutter members cannot be fully cleaned and, what is more, erratic transfer of the shutter members will prevent their positive and consistent cleaning.

SUMMARY OF THE INVENTION

An object, therefore, of the present invention is to provide a method that is capable of cleaning members of interest in a positive and effective manner and which gives due consideration to the treatment of effluents that result from the cleaning operation.

Another object of the present invention is to provide an apparatus that is suitable for use in implementing this method.

To attain these and other objects, the present invention provides a method of supplying a cleaning solution to an apparatus in which a plurality of members are transferred continuously in a specified direction as they are cleaned with the cleaning solution that is applied through a plurality of cleaning nozzles provided side by side in the specified direction. The plurality of nozzles are divided into at least two groups, one of which is a first group of nozzles arranged downstream with respect to the specified direction and the other being a second group of nozzles arranged upstream with respect to the specified direction.

The method comprises (a) the step of supplying the cleaning solution to the first group of cleaning nozzles, (b) the step of supplying the second group of cleaning nozzles with the cleaning solution which has been applied to the members through the first group of cleaning nozzles, (c) the step of removing impurities from the cleaning solution which has been applied to the members through the second group of cleaning nozzles, and (d) the step of supplying the first group of nozzles with the cleaning solution which has been freed of the impurities in step (c).

The present invention also provides for an apparatus for cleaning a plurality of members by applying a cleaning solution to the members as they are transferred continuously in a specified direction. The apparatus comprises: a plurality of cleaning nozzles provided side by side for applying the cleaning solution to the members, the nozzles being divided into a plurality of groups that are consecutive in the specified direction; a plurality of vessels for supplying the cleaning solution into the respective groups of nozzles and receiving it therefrom; a flow line for connecting a set of adjacent two of the vessels in the specified direction so that the cleaning solution flows out of one of the adjacent vessels that is positioned downstream with respect to the specified direction to enter the other vessel; a recovery line for withdrawing the cleaning solution from one of the vessels that is positioned most upstream with respect to the specified direction; a separation unit for removing impurities from the cleaning solution which has been received via the recovery line; and a connecting line for supplying the cleaning solution from the separation unit into one of the vessels that is positioned most downstream of the specified direction.

The present invention further provides for an apparatus for cleaning a plurality of generally U-shaped members by applying a cleaning solution to the members as they are transferred continuously in a specified direction. The apparatus comprises a guide rail that extends in the specified directions for transferring the members in the specified direction, and a plurality of cleaning nozzles provided side by side in the specified direction for applying the cleaning solution to the members. The guide rail has a width large enough to insure that the generally U-shaped members mounted over the guide rail will not rotate about the latter and through-holes that extend in a direction generally transverse to the specified direction are formed in the guide rail.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
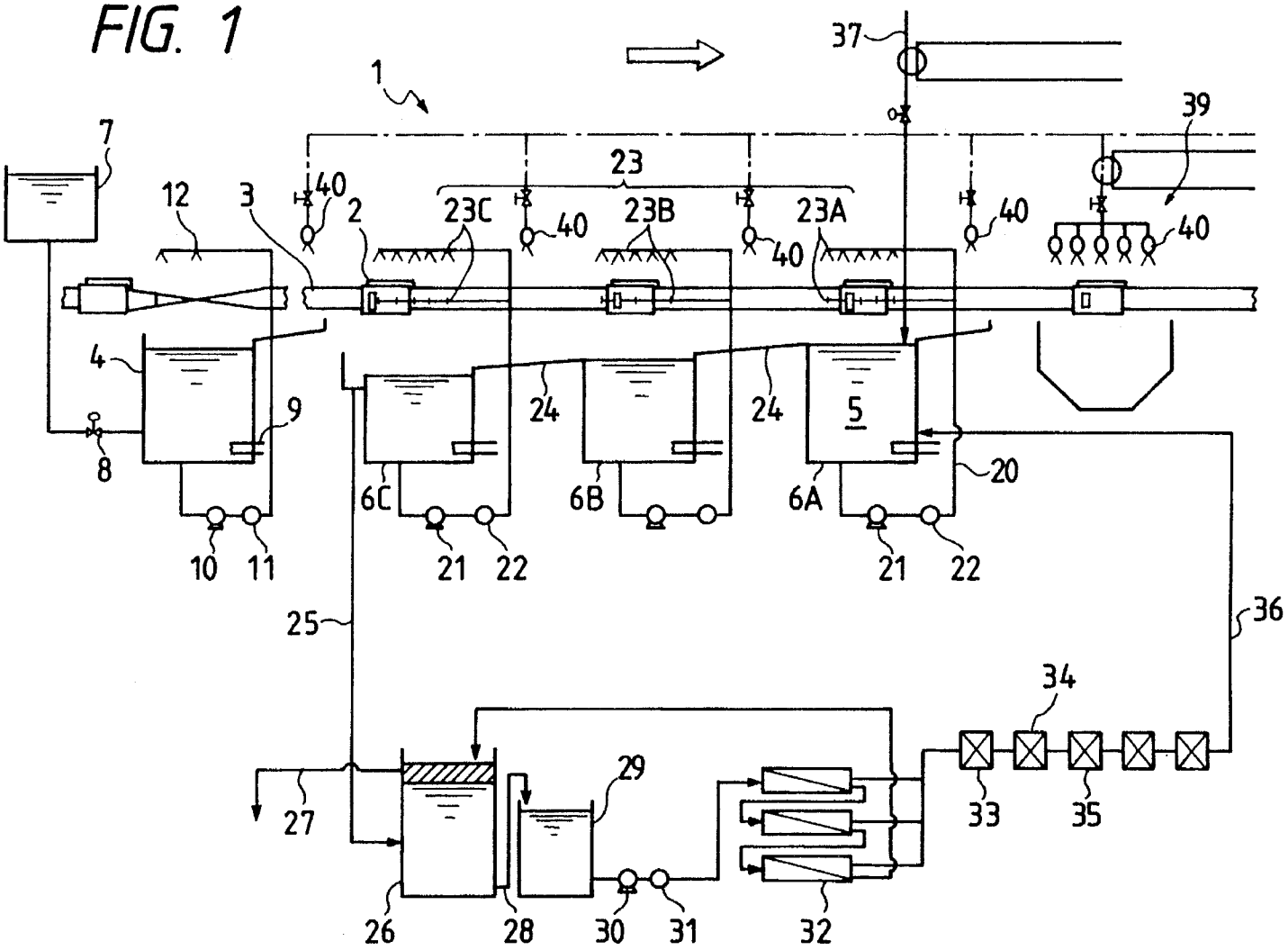
FIG. 1 is a diagram schematically showing an apparatus for cleaning shutter members in an example of the present invention.

An example of the cleaning method and apparatus of the present invention is described below with reference to the accompanying drawings wherein like reference numerals designate identical or corresponding parts throughout the several views.

First, an embodiment of the example of the cleaning method of the present invention is described with reference to FIGS. 1 to 3.

The cleaning method of the present invention is suitable for cleaning stainless steel, aluminum or other metallic shutter members in a blanked and generally U-shaped form as they are fed continuously. As shown in FIG. 1, a plurality of shutter members 2 that are mounted over a guide rail 3 are transferred in a specified direction (as indicated by the arrow in FIG. 1) as they are cleaned with a cleaning solution 5 that is being supplied through a plurality of cleaning nozzles 23. The cleaning solution 5 is circulated in the following manner: the cleaning solution 5 that has been used by a group of cleaning nozzles 23 downstream with respect to the direction of transfer of shutter members 2 is used by sequentially upstream groups of nozzles 23 and the cleaning debris which has been removed from the shutter members 2 is separated from the cleaning solution 5 that has been finally used by the most upstream group of nozzles 23, and the thusly treated cleaning solution is again supplied to the most downstream group of nozzles 23 for another use in the cleaning of the shutter members 2. In the example under consideration, the cleaning nozzles 23 are divided into three groups, 23A (the moist downstream group), 23B (the intermediate group) and 23C (the most upstream group).

The shutter members 2 shown in FIG. 1 are exemplified by floppy disks of common use, which are blanked from stainless steel, aluminum and other metal sheets, bent in a generally U-shape and fed continuously. Almost all of these shutter members 2 are usually soiled by the deposit of working oils. Therefore, the first part of the cleaning method of the present invention requires not only the step of cleaning the working oil but also the step of rinsing the working oil and detergent. It should be mentioned here that if the working oil to be used in the blanking step for the making of shutter members 2 is of the type that is described below, a particular advantage will result in that the step of cleaning the working oil can be omitted and that the shutter members can be directly cleaned with an aqueous solution.

Figure 3:
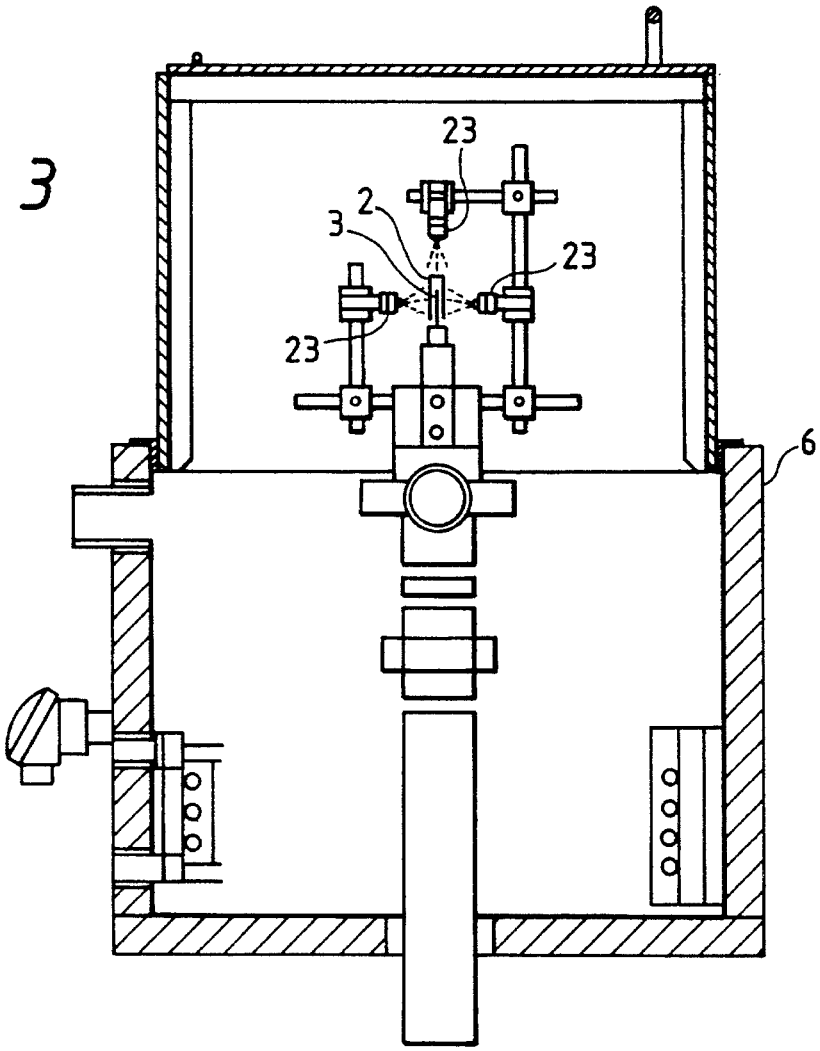
FIG. 3 is a sectional view showing a part of the apparatus as it is taken in a direction transverse to the direction of transfer or,the shutter members.

Cleaning of the shutter members 2 with a plurality of nozzles 23 is desirably performed not only from above but also from both lateral sides as shown in FIG. 3. Satisfactory cleaning can be accomplished if the jet angle of the nozzles 23 ranges from 20° to 160° with respect to the direction of transfer of shutter members 2. The temperature of the cleaning solution is desirably in the range from room temperature to 100° C., and the speed of jetting the cleaning solution is desirably at least 0.1 to 2 m/sec.

In the example under consideration, the cleaning solution 5 may be circulated in the following fashion. As shown in FIG. 1, the cleaning solution 5 is caused to flow from supply vessel 6A through supply vessel 6B to supply vessel 6C via flow lines 24 extending along guide rail 3 in order to assure that the cleaning solution 5 that has been used by nozzle group 23A (above supply vessel 6A) which is downstream with respect to the direction of transfer of shutter members 2 is used by sequentially upstream nozzle groups 23B and 23C (above supply vessels 6B and 6C, respectively). Then, the cleaning solution 5 that has been finally used by the most upstream nozzle group 23C is passed through a separation unit to reject the cleaning debris that has been removed from the shutter members 2. The cleaned solution 5 is again supplied into the supply vessel 6A for another use by the most downstream nozzle group 23A to clean the shutter members 2.

According to the above-described cleaning method of the present invention, the oil content and other contaminants can be thoroughly removed from the shutter members 2 by means of cleaning nozzles and the thusly removed oil content and other contaminants can be efficiently separated from the cleaning solution 5 for another use. Hence, the method offers the advantage of facilitating the treatment of effluents from the system.

As already mentioned in passing, if a working oil of a special kind is used in the blanking step of the process of making shutter members, the step of removing the working oil with detergents can be omitted and an aqueous solution may be used in the rinse step. Stated more specifically, detergent vessel 4 (see FIG. 1) can be omitted and the cleaning solution 5 can be replaced by a safe and easy-to-handle aqueous solution. The working oil of special kind that offers these advantages is a mineral oil that is processed to contain a dicarboxylic acid ester having an aliphatic hydrocarbon in the backbone chain. Exemplary mineral oils include $C_{10-18}$ branched hydrocarbons, straight hydrocarbons and terpenicihydrocarbons such as diterpene; these mineral oils may be used either individually or in admixtures. Exemplary dicarboxylic acid esters include diisopropyl succinate, diisopropyl glutarate and diisopropyl adipate; these compounds may be used either individually or in admixtures.

The mixing ratio of mineral oil to dicarboxylic acid ester is preferably such that the dicarboxylic acid ester is used in an amount of 0.1 to 15 parts by weight per 100 parts by weight of the mineral oil; more preferably, the ester is used in an amount of 0.5 to 10 parts by weight per 100 parts by weight of the mineral oil. If the ester is used in less than 0.1 part by weight per 100 parts by weight of the mineral oil, the intended result cannot be achieved in such aspects as the cleaning effect. Adding more than 15 parts by weight of the ester is also undesirable since there is no particular enhancement of effectiveness. Preferably, polyoxyether may be added in addition to the mixture of mineral oil and dicarboxylic acid ester. If polyoxyether is to be added, its amount ranges preferably from 100 to 0.1 part by weight, more preferably from 10 to 0.1 part by weight, per part by weight of the dicarboxylic acid ester.

Such working oils permit easy rinsing even if the cleaning solution 5 is replaced by an aqueous solution. Hence, there is no need to use 1,1,1-trichloroethane, carbon tetrachloride or other environmentally unfriendly organic solvents which have heretofore been used as rinsing agents for working oils and detergents. Thus, coupled with the cleaning effect of nozzles 23, the use of the special kind of working oils described above insures that shutter members 2 can be cleaned thoroughly without polluting the environment. It should also be added that the oils of the type described above also serve as detergents, thereby contributing to the prevention of environmental pollution.

If desired, an oil composition comprising a mineral oil as the base and an additive such as antioxidant or rust inhibitor may be added to the working oil having the formula specified above and the resulting blend may be used as a working oil or detergent. Any known cutting oils may be used as such oil composition without particular limitation. To name a few examples, commercial grades such as "Irobroach 11" (the trade name of Castroll Co.) and "6100" (the trade name of Nippon Kosakuyusha) may preferably be used. In the case under consideration, the working oil is preferably used in an amount of 5 to 100 parts by weight, more preferably 10 to 50 parts by weight, per 100 parts by weight of the oil composition. If the working oil is used in less than 5 parts by weight per 100 parts by weight of the oil composition, the intended result cannot be achieved in such aspects as the cleaning effect. Adding more than 100 parts by weight of the working oil is also undesirable since there is no particular enhancement of effectiveness. The oil having the formula just described above will prove to be as effective in cleaning as the working oil discussed in the preceding paragraphs.

The cleaning apparatus of the example under consideration will now be described in detail.

Figure 2:
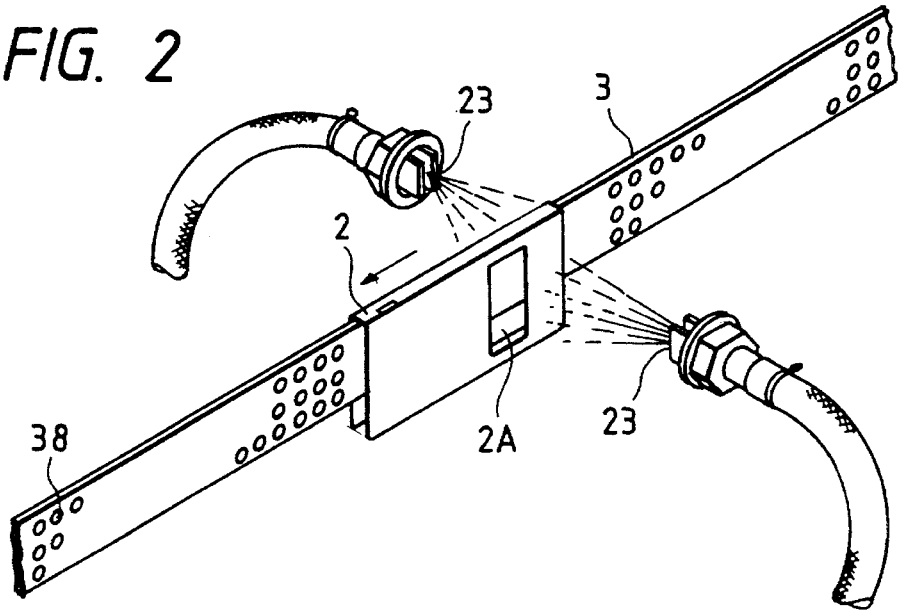
FIG. 2 is a perspective view showing two cleaning nozzles and the associated parts of the apparatus for cleaning shutter members which are shown in FIG. 1.

The cleaning apparatus generally indicated by 1 in FIG. 1 is suitable for cleaning stainless steel shutter members in a blanked and generally U-shaped form as they are fed continuously (see FIGS. 1 to 3).

The cleaning apparatus 1 comprises the guide rail 3 which guides the shutter members 2 so that they are transferred continuously in the specified direction (indicated by arrow in FIG. 1), and the plurality of cleaning nozzles 23 for spraying the cleaning solution 5 onto the shutter members 2. A plurality of supply vessels 6 for supplying the cleaning solution 5 into nozzle groups each having one or more cleaning nozzles 23 are provided along the guide rail 3. As already mentioned, three nozzle groups 23A, 23B and 23C and the corresponding supply vessels 6A, 6B and 6C are provided in the example under consideration. Flow channels 24 are provided in such a way that the excess quantity of cleaning solution 5 overflowing the supply vessel 6A will flow sequentially into supply vessels 6B and 6C upstream the rail 3. The most upstream supply vessel 6C is connected to a recovery pipe 25 for withdrawing the cleaning solution 5. It is via the recovery pipe 25 that the cleaning solution 5 is supplied to a separation unit (as consisting of parts that are indicated by 26 to 35 in FIG. 1) for separating out the cleaning debris which has been removed from the shutter members 2. The separation unit is connected to the most downstream supply vessel 6A via a pipe 36.

The apparatus 1 for cleaning shutter members in the example under consideration is described below more specifically. As shown in FIG. 1, the cleaning apparatus 1 is equipped with rail 3 for guiding shutter members 2. Below the guide rail 3, there are provided a detergent vessel 4 and a plurality of vessels 6C, 6B and 6A for supplying the cleaning solution 5, which are arranged in the order from upstream to downstream with respect to the direction of transfer of shutter members 2. The vessel 4 is a reservoir of detergent which is supplied thereto from a detergent supply vessel 7 via a regulating valve 8. The detergent as warmed to an appropriate temperature with a heater 9 passes through a pump 10 and a filter 11 to be jetted through detergent nozzles 12. The part of guide rail 3 which is located above the detergent vessel 4 is twisted to insure that the shutter members 2 will be inverted as they are transferred below the nozzles 12.

The supply vessels 6A, 6B and 6C are each a reservoir of cleaning solution 5, which is an aqueous solution serving as a rinse agent for removing the oil content and the detergent that has been applied to the shutter members 2 in the preceding step. Supply vessels 6A, 6B and 6C are each fitted with a temperature-adjustable heater 20 so that the cleaning solution 5 is warmed to between room temperature and 100° C., preferably between room temperature and 70° C. The cleaning solution 5 in each supply vessel is supplied to cleaning nozzles 23 via a pump 21 and a filter 22 and thereafter jetted onto the shutter members through those nozzles 23. The mesh size of filter 22 varies with the supply vessel to which it is connected: for vessel 6A, the filter size is 0.1 μm; for vessel 6B, it is 10 μm; and for vessel 6C, the size is 25 μm.

As shown in FIG. 3, cleaning nozzle 23 can be provided not only above the shutter member 2 but also on both lateral sides thereof and the cleaning solution 5 is jetted at an angle generally perpendicular to the direction of transfer of shutter member 2. The angle of jetting the cleaning solution 5 is preferably about 90° with respect to the direction of transfer of shutter member 2 but it may vary over the range from 20° to 160°. The jet speed of the cleaning solution is desirably from 0.1 to 2 m/sec, more desirably from 0.5 to 1 m/sec. In the example under consideration, the cleaning solution 5 is set at a temperature of 50° C. and it is jetted at a speed of 0.81 m/sec.

The supply vessels 6A, 6B and 6C are connected to flow channels 24 and the cleaning solution 5 overflowing supply vessel 6A will flow sequentially into supply vessels 6B and 6C. Supply vessel 6C which is positioned most upstream with respect to the direction of transfer of shutter members 2 is connected to recovery pipe 25 which, in turn, communicates with a recovery vessel 26 that is one component of the separation unit. The top of the recovery vessel 26 is fitted with a line 27 for withdrawing the oil content that has been removed from the shutter members 2 and the bottom of the vessel 26 is fitted with a pipe 28 that connects to a reservoir tank 29. The oil content in the line 27 is refined and can be returned to the detergent supply vessel 7.

Reservoir tank 29 is connected to a pump 30, a filter 31 and a refining high-performance separation filter assembly 32 in the order written. The filter assembly 32 in turn communicates with different means 33, 34 and 35 for treatment with activated carbon, ion-exchange resins and by uv sterilization. The last uv sterilization means 35 is connected to a pipe 36 which, in turn, communicates with the most downstream supply vessel 6A. Thus, the cleaning solution 5 is circulated and the flow rate of circulation is set at 5 L/min in the example under consideration. To make up for any insufficiency of the cleaning solution 5, the supply vessel 6A is connected to a replenishing pipe 37.

Those areas of the guide rail 3 which are situated above the supply vessels 6A, 6B and 6C have a number of holes 38 through which the cleaning solution can pass (see FIG. 2). The guide rail 3 is formed wide enough to insure that shutter members 2 can effectively be prevented from rotating about the guide rail 3. The holes 38 permit the passage of the cleaning solution 5 through "window" 2A in each shutter member 2, thereby contributing to efficient cleaning of the inner surfaces of the shutter member 2. Mechanism 39 for drying shutter members 2 is provided downstream of the supply vessel 6A. Shown by 40 in FIG. 1 are nozzles for blowing hot or cold air onto shutter members 2.

Having the construction described above, the apparatus 1 is capable of efficiently cleaning the shutter members 2 on the guide rail 3 and, at the same time, the cleaning solution 5 is circulated to substantially eliminate the need to treat the effluents.

It is also noted that if, in the example described above, an oil that comprises a mineral oil as a base and which further contains a dicarboxylic acid ester having an aliphatic hydrocarbon in the backbone chain is used as a working oil in the blanking step of the process of making shutter members, the need to equip the system with detergent nozzles 12 and detergent vessel 4 is eliminated. As a further advantage, the cleaning solution 5 can be an aqueous solution which is easy to handle and this provides ease in handling filters and other components of the separation unit.

An example of the present invention is a method of cleaning stainless steel or aluminum shutter members in a blanked and generally U-shaped form as they are fed continuously. According to the method, the shutter members are transferred in a specified direction as they are cleaned with a cleaning solution that is applied through a plurality of nozzles. The cleaning solution is circulated in such a way that the cleaning solution that has been used by a group of nozzles downstream with respect to the direction of transfer of the shutter members is used by sequentially upstream groups of nozzles and the cleaning debris which has been removed from the shutter members is separated from the cleaning solution that has been finally used by the most upstream group of nozzles, and the thus cleaned solution is again supplied to the most downstream group of nozzles for another use in cleaning the shutter members.

Another example of the present invention is an apparatus for cleaning stainless steel or aluminum shutter members in a blanked and generally U-shaped form as they are fed continuously. The apparatus comprises a guide rail for guiding the shutter members so that they are transferred in a specified direction and a plurality of cleaning nozzles through which a cleaning solution is sprayed onto the shutter members. The apparatus further includes a plurality of vessels provided along the guide rail for supplying the cleaning solution to one or more cleaning nozzles, flow lines in which the cleaning solution overflowing a supply vessel downstream the guide rail flows into sequentially upstream supply vessels, a recovery line connected to the most upstream supply vessel for recovering the cleaning solution, a separation unit by which the cleaning debris that has been removed from the shutter members is separated out from the cleaning solution coming through the recovery line, and a line for connecting the separation unit and the most downstream supply vessel.

Yet another example of the present invention is an apparatus for cleaning stainless steel or aluminum shutter members in a blanked and generally U-shaped form as they are fed continuously. The apparatus comprises a guide rail for guiding the shutter members so that they are transferred in a specified direction and a plurality of cleaning nozzles through which a cleaning solution is sprayed onto the shutter members. The guide rail is formed wide and has a plurality of holes through which the cleaning solution can pass.

The shutter members in a blanked form are bent in a generally U-shape with a working oil and other contaminants deposited on their surface and are thereafter transferred sequentially along the guide rail. The shutter members in the process of transfer are freed of the working oil with the cleaning solution that is sprayed from the cleaning nozzles. If the guide rail is formed wide enough to insure that the shutter members are effectively prevented from rotating about the guide rail and if through-holes are formed in selected areas of that rail, the cleaning solution can be passed through the "window" of each shutter member and its inner surfaces can be cleaned efficiently as it is transferred along the rail.

On the other hand, the concentrations of the working oil and other contaminant is in the cleaning solution will increase as they are removed progressively from the shutter members and the ability of the cleaning solution will decrease accordingly. However, in the present invention, the cleaning solution of high capability is sequentially used in the order from downstream to upstream with respect to the direction of transfer of the shutter members and at the upstream end, the exhausted cleaning solution is recovered and freed of the working oil and other contaminants so that its cleaning capability is enhanced for another use at the downstream end. This circulation of the cleaning solution substantially eliminates the need to perform the treatment of effluents from the cleaning system.

Obviously numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An apparatus for cleaning a plurality of generally U-shaped members by applying a cleaning solution to said members as they are transferred continuously in a specified direction, said apparatus comprising:

a guide rail that extends in said specified direction, the U-shaped members being mounted on said guide rail which guides the U-shaped members in said specified direction to thereby permit a continuous transfer of said members in said specified direction; and a plurality of cleaning nozzles provided side by side in said specified direction for applying the cleaning solution to said members;

wherein:

said guide rail has a width large enough to insure that said generally U-shaped members mounted over said guide rail will not rotate about the latter; and through-holes that extend in a direction generally transverse to said specified direction are formed in said guide rail.

2. An apparatus according to claim 1, wherein said cleaning nozzles apply the cleaning solution to said members at least in a direction substantially transverse to said specified direction.

* * * * *